US007306014B2

(12) United States Patent
Nagura et al.

(10) Patent No.: US 7,306,014 B2
(45) Date of Patent: Dec. 11, 2007

(54) INDUSTRIAL TWO-LAYER FABRIC

(75) Inventors: Hiroyuki Nagura, Shizuoka (JP); Ikuo Ueda, Shizuoka (JP); Keiichi Takimoto, Shizuoka (JP)

(73) Assignee: Nippon Filcon Co., Ltd., Tokyo (JP)

( * ) Notice: Subject to any disclaimer, the term of this patent is extended or adjusted under 35 U.S.C. 154(b) by 171 days.

(21) Appl. No.: 11/270,593

(22) Filed: Nov. 10, 2005

(65) Prior Publication Data

US 2006/0116042 A1 Jun. 1, 2006

(30) Foreign Application Priority Data

Nov. 30, 2004 (JP) ..... 2004-346310

(51) Int. Cl.

| | |
|---|---|
| ***D21F 1/10*** | (2006.01) |
| ***D21F 7/08*** | (2006.01) |
| ***D03D 11/00*** | (2006.01) |
| ***D03D 3/04*** | (2006.01) |
| *D03D 25/00* | (2006.01) |

(52) U.S. Cl. ..... 139/383 A; 139/383 AA; 139/408; 139/413; 162/358.2; 162/900; 162/902; 162/903; 442/203; 442/205; 442/206; 442/207; 442/208

(58) Field of Classification Search ..... 139/383 A, 139/383 AA, 408, 413; 162/358.2, 900, 162/902, 903; 442/203, 205, 206, 207, 208
See application file for complete search history.

(56) References Cited

U.S. PATENT DOCUMENTS 4,376,455 A * 3/1983 Hahn ..... 139/383 A
4,515,853 A * 5/1985 Borel ..... 442/205
5,022,441 A * 6/1991 Tate et al. ..... 139/383 A
5,103,875 A * 4/1992 Tate et al. ..... 139/383 A
5,487,414 A * 1/1996 Kuji et al. ..... 139/383 A
5,490,543 A * 2/1996 Fujisawa ..... 139/383 A
6,202,705 B1 3/2001 Johnson (Continued)

FOREIGN PATENT DOCUMENTS

EP 0345643 B1 6/1989
EP 0345643 A2 12/1989
EP 1365066 A1 11/2003

(Continued)

OTHER PUBLICATIONS

European Search Report

*Primary Examiner*—Andrew T Piziali
(74) *Attorney, Agent, or Firm*—Rader, Fishman & Grauer PLLC

(57) ABSTRACT

In a lower surface side layer of an industrial two-layer fabric, warps are formed by sequentially arranging a repeating design unit, in which one warp passes over six successive lower surface side wefts, passes under one lower surface side weft, passes over two lower surface side wefts, and passes under one lower surface side weft while shifting the design by three lower surface side wefts. Two adjacent lower surface side warps simultaneously weave therein, from the lower surface side, one lower surface side weft, whereby the lower surface side weft passes over two lower surface side warps and then passes under eight lower surface side warps to form a weft long crimp corresponding to eight lower surface side warps on the lower surface side surface.

9 Claims, 15 Drawing Sheets

U.S. PATENT DOCUMENTS

| | | | | |
|---|---|---|---|---|
| 6,510,873 | B2 * | 1/2003 | Nagura | 139/383 A |
| 6,860,299 | B2 | 3/2005 | Kuji | |
| 7,073,539 | B2 * | 7/2006 | Takimoto et al. | 139/383 A |
| 7,108,019 | B2 * | 9/2006 | Nagura et al. | 139/383 A |
| 2004/0079434 | A1 | 4/2004 | Martin et al. | |
| 2004/0089365 | A1 * | 5/2004 | Heger et al. | 139/383 A |
| 2005/0229995 | A1 * | 10/2005 | Ito et al. | 139/383 A |
| 2006/0048839 | A1 * | 3/2006 | Fujisawa | 139/383 A |

FOREIGN PATENT DOCUMENTS

| | | | |
|---|---|---|---|
| EP | 1630271 | A2 | 3/2006 |
| NO | 314947 | B1 | 3/2000 |
| NO | 317618 | B1 | 1/2002 |
| WO | WO-2004/038094 | A1 | 5/2004 |

* cited by examiner

INDUSTRIAL TWO-LAYER FABRIC

The present invention relates to an industrial two-layer fabric used for papermaking, filter cloth, transport and the like.

BACKGROUND OF THE INVENTION

Fabrics obtained by weaving warps and wefts have conventionally been used widely as an industrial fabric. They are, for example, used in various fields including papermaking wires, conveyor belts and filter cloths and are required to have fabric properties suited for the intended use or using environment. Of such fabrics, a papermaking wire used in a papermaking step for removing water from raw materials by making use of the network of the fabric must satisfy a severe demand. There is therefore a demand for the development of fabrics which do not transfer a wire mark of the fabric and therefore have excellent surface property, have enough rigidity and therefore are usable desirably even under severe environments, and are capable of maintaining conditions necessary for making good paper for a prolonged period of time. In addition, fiber supporting property, improvement in a papermaking yield, good water drainage property, wear resistance, dimensional stability and running stability are demanded. In recent years, owing to the speed-up of a papermaking machine, requirements for papermaking wires become severe further.

Since most of the demands for industrial fabrics and solutions thereof can be understood if papermaking fabrics on which the most severe demand is imposed among industrial fabrics will be described, the present invention will hereinafter be described by using the papermaking fabric as a representative example.

In the paper making machine, an increase in paper making speed inevitably raises dehydration speed so that dehydration power must be reinforced. Examples of the fabric with good dehydration property include two-layer fabric having a dehydration hole penetrating from the upper surface side toward the lower surface side of the fabric. Particularly, a two-layer fabric using a warp binding yarn which is woven with an upper surface side weft and a lower surface side weft to constitute an upper surface side surface design and a lower surface side surface design is developed with a view to satisfying the surface property, fiber supporting property and dehydration property which a papermaking fabric is required to have. A two-layer fabric using a warp binding yarn is described in Japanese Patent Laid-Open Publication No. 2004-36052. The fabric disclosed in the above-described invention is a two-layer fabric using, as some warps, a warp yarn functioning as a binding yarn to weave therewith an upper surface side layer and a lower surface side layer. Two warp binding yarns forming a pair complement each other to form the upper surface side surface design and the lower surface side surface so that the fabric has excellent surface property and binding strength. A lower surface side design of the fabric in Examples 1 to 3 of Japanese Patent Laid-Open Publication No. 2004-36052 is however a ribbed design in which two lower surface side warps are arranged in parallel with the same design and a lower surface side weft is designed to form a short crimp corresponding to only two warps on the lower surface side surface so that the fabric has poor wear resistance.

SUMMARY OF THE INVENTION

The above-described two-layer fabric has dehydration holes penetrating completely from the upper surface side layer toward the lower surface side layer and these holes are arranged over the whole surface so that the fabric has good dehydration property. They are however such drawbacks as sticking, into the fiber, of a sheet raw material over a wire or loss of fiber or filler owing to strong vacuum, which sometimes leads to remarkable generation of dehydration marks.

Thus, industrial fabrics capable of satisfying all of the surface property, fiber supporting property and wear resistance have not yet been developed.

With the foregoing problems in view, the present invention has been made. An object of the present invention is to provide an industrial fabric capable of preventing drastic dehydration and generation of dehydration marks resulting therefrom and having excellent surface property, fiber supporting property and wear resistance.

The present invention relates to an industrial two-layer fabric which comprises ten pairs of warps obtained by vertically arranging ten upper surface side warps and ten lower surface side warps, and a plurality of upper surface side wefts and lower surface side wefts. The industrial Layer fabric of the present invention has an upper surface side layer and a lower surface side layer bound with warp-direction yarns. In the lower surface side layer, the warps are formed by sequentially arranging a repeating design in which one warp passes over six successive lower surface side wefts, passes under one lower surface side weft, passes over two lower surface side wefts, and passes under one lower surface side weft while shifting the design by three lower surface side wefts. Two adjacent lower surface side warps simultaneously weave therein one lower surface side weft from the lower surface side, whereby the lower surface side weft passes over two lower surface side warps and then passes under eight lower surface side warps to form a weft long crimp corresponding to eight lower surface side warps on the lower surface side surface; and by forming a portion in which a lower surface side warp and each of lower surface side warps on both adjacent sides thereto alternately passes under a lower surface side weft, the lower surface side warp is brought into contact with the lower surface side warps on both adjacent sides thereto alternately and is placed in a zigzag arrangement.

An upper surface side warp and lower surface side warp of at least one of the ten pairs of an upper surface side warp and a lower surface side warp arranged vertically in the two layer fabric of this invention may be both warp binding yarns which are woven with an upper surface side weft and a lower surface side weft to constitute a portion of an upper surface side surface design and a portion of a lower surface side surface design; and warp binding yarns forming a pair are woven with respective upper surface side wefts and cooperatively function as one warp to constitute an upper surface side complete design on an upper surface side surface, while the warp binding yarns forming a pair constitute, similar to a lower surface side warp, a lower surface side surface design on the lower surface side surface.

In the industrial two-layer fabric of the present invention, an upper surface side warp of at least one of the ten pairs of an upper surface side warp and a lower surface side warp arranged vertically may be a warp binding yarn which is woven with an upper surface side weft and a lower surface side weft to constitute a portion of an upper surface side surface design and a portion of a lower surface side surface design; and in the pair of a warp binding yarn and a lower surface side warp, the warp binding yarn is woven with an upper surface side weft to function as one warp constituting an upper surface side complete design on an upper surface side surface, while on the lower surface side surface, the warp binding yarn and the lower surface side warp cooperatively constitute, similar to another lower surface side warp, a lower surface side surface design.

In an industrial two-layer fabric which comprises ten pairs of warps obtained by vertically arranging ten upper surface side warps and ten lower surface side warps, and a plurality of upper surface side wefts and lower surface side wefts, and has an upper surface side layer and a lower surface side layer bound with warp-direction yarns, a lower surface side layer is formed with a complete design obtained by sequentially arranging a design in which one warp passes over six successive lower surface side wefts, passes under one lower surface side weft, passes over two lower surface side wefts, and passes under one lower surface side weft, while shifting this design by three lower surface side wefts; two adjacent lower surface side warps simultaneously weave therein, from the lower surface side, one lower surface side weft, thereby forming a weft long crimp corresponding to eight lower surface side warps on the lower surface side surface; and at the same time, a lower surface side warp is placed in a zigzag arrangement while being brought into contact with each of lower surface side warps on both adjacent sides alternately. This makes it possible to improve the rigidity, diagonal rigidity and wear resistance of the fabric. Moreover, since water drainage property is made uneven by forming both an overlapped portion and a non-overlapped portion between warp-direction yarns constituting the upper surface side layer and warp-direction yarns constituting the lower surface side layer, dehydration occurs stepwise and therefore, generation of dehydration marks, sticking of a sheet raw material on a wire, loss of fiber or filler can be suppressed.

DETAILED DESCRIPTION OF THE INVENTION

Figure 1:
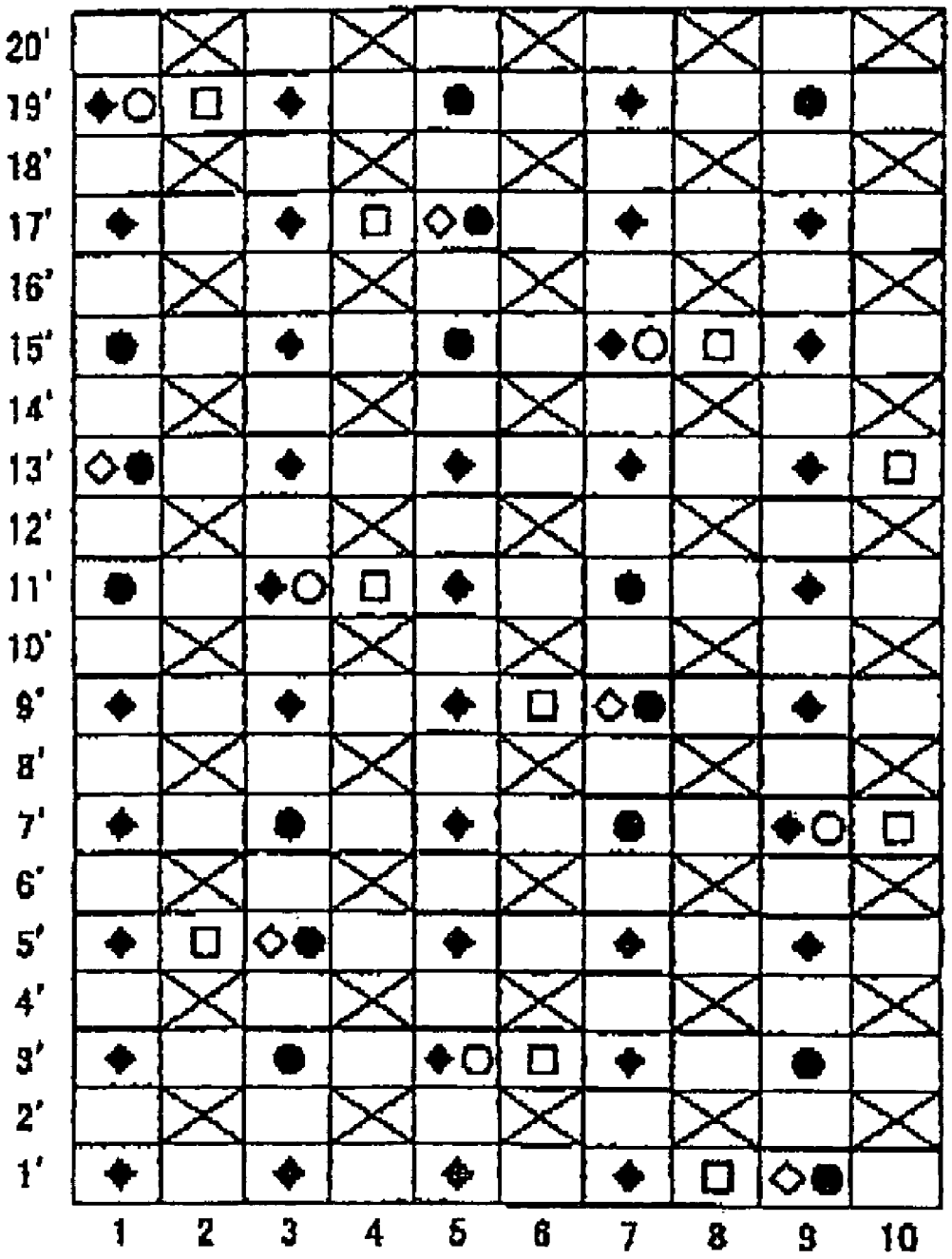
FIG. 1 is a design diagram illustrating the complete design of Example 1 of the present invention.

The present invention provides an industrial two-layer fabric which comprises ten pairs of warps obtained by vertically arranging ten upper surface side warps and ten lower surface side warps, and a plurality of upper surface side wefts and lower surface side wefts, and has an upper surface side layer and a lower surface side layer bound with warp-direction yarns, characterized in that the lower surface side layer has a design in which one warp passes over six successive lower surface side wefts, passes under one lower surface side weft, passes over two lower surface side wefts, and passes under one lower surface side weft and is formed by sequentially arranging this design while shifting the design by three lower surface side wefts; two adjacent lower surface side warps simultaneously weave therein one lower surface side weft from the lower surface side, whereby the lower surface side weft passes over two lower surface side warps and then passes under eight lower surface side warps to form a weft long crimp corresponding to eight lower surface side warps on the lower surface side surface; and by forming a portion in which a lower surface side warp and each of lower surface side warps on both adjacent sides thereto alternately passes under a lower surface side weft, the lower surface side warp is brought into contact with the lower surface side warps on both adjacent sides thereto alternately and is placed in a zigzag arrangement.

Two adjacent lower surface side warps firmly weave therein a lower surface side weft so that the resulting fabric has excellent rigidity. In addition, a weft long crimp corresponding to eight lower surface side warps is formed on the lower surface side surface so that the resulting fabric has improved wear resistance. Moreover, the number of weaving times of a lower surface side weft with a warp is so small that it is possible to increase the hooting count of the lower surface side weft or widen its diameter. An overlapped portion and a non-overlapped portion between warp-direction yarns constituting the upper surface side layer and warp-direction yarns constituting the lower surface side layer are caused to exist as a mixture by employing a design in which a lower surface side warp is brought into contact with the lower surface side warps on both adjacent sides thereto alternately and is placed in a zigzag arrangement. Owing to this structure, a network having a free size or shape can be formed, which permits stepwise progress of dehydration and makes it possible to inhibit generation of dehydration marks, sticking of a sheet raw material on a wire and loss of fiber or filler. Moreover, the resulting fabric has improved rigidity in its oblique direction by placing lower surface side warps in a zigzag arrangement.

The industrial two-layer fabric of the present invention may be composed of ten pairs of warps obtained by arranging ten upper surface side warps and ten lower surface side warps vertically, and a plurality of upper surface side wefts and lower surface side wefts. As a binding yarn for weaving the upper surface side layer with the lower surface side layer, a warp binding yarn woven with an upper surface side weft and a lower surface side weft to constitute a portion of an upper surface side surface design and a portion of a lower surface side surface design is employed.

The warp binding yarn may be arranged in any one of the following manners: at least one pair, of ten pairs of an upper surface side warp and a lower surface side warp vertically arranged, has two warp binding yarns instead of the upper surface side warp and lower surface side warp; at least one pair, of ten pairs of an upper surface side warp and a lower surface side warp vertically arranged, has a warp binding yarn, which has been substituted for the upper surface side warp, and the lower surface side warp; and at least one pair, of ten pairs of an upper surface side warp and a lower surface side warp vertically arranged, has a warp binding yarn, which has been substituted for the lower surface side warp, and the upper surface side warp. The term "pair" as used herein means a pair of an upper surface side warp and one lower surface side warp vertically arranged. In the present invention, ten upper surface side warps and ten lower surface side warps constitute ten pairs. The term "pair" also means a pair of two warp binding yarns employed respectively as an upper surface side warp and a lower surface side warp, a pair of an upper surface side yarn and a warp binding yarn substituted for a lower surface side warp yarn and a pair of a lower surface side warp and a warp binding yarn substituted for an upper surface side warp yarn.

When two warp binding yarns form a pair, they may be woven with respective upper surface side wefts and cooperatively function as one warp constituting an upper surface side complete design on the upper surface side surface, while they form, similar to a lower surface side warp, a lower surface side surface design on the lower surface side surface. Particularly in this design, one of warp binding yarns forming a pair is woven with at least one upper surface side weft to form an upper surface side surface design, under which the other warp binding yarn is woven with one lower surface side weft, while the one warp binding yarn is woven with one lower surface side weft, over which the other warp binding yarn is woven at least one upper surface side weft to constitute the upper surface side surface design. Thus, warp binding yarns forming a pair are able to complement each other to form the upper surface side surface design and lower surface side surface design.

In the case of a pair of a warp binding yarn and a lower surface side warp, the warp binding yarn may be woven with an upper surface side weft and functions as one warp constituting an upper surface side complete design on the upper surface side surface, while the warp binding yarn and lower surface side warp cooperatively form, similar to another lower surface side warp, a lower surface side surface design on the lower surface side surface.

In the case of a pair of a warp binding yarn and an upper surface side warp, the warp binding yarn and upper surface side warp may be woven with respective upper surface side wefts and cooperatively function as one warp constituting an upper surface side complete design on the upper surface side surface, while the warp binding yarn forms, similar to a lower surface side warp, a lower surface side surface design on the lower surface side surface.

In the fabric of the present invention, binding is achieved by a warp binding yarn extending in a warp direction. The yarn serving as a binding yarn is a warp-direction one to which tension is always applied. Compared with a conventional thin weft binding yarn, it has a very strong power for binding the upper surface side layer and the lower surface side layer and has good adhesion. Accordingly, problems such as weakening of a binding power owing to internal wear caused by friction between these two layers, appearance of a space between layers and separation of two layers scarcely occur. In addition, since an additional binding yarn such as weft binding yarn is not used, it is possible to increase the count of wefts or widen their diameter, which leads to improvement in the rigidity of a whole fabric.

The lower surface side complete design (or a repeating unit) composed of warp binding yarns, lower surface side warps and lower surface side wefts is formed by sequentially arranging a design in which a warp passes over six successive lower surface side wefts, passes under one lower surface side weft, passes over two lower surface side wefts and passes under one lower surface side weft, while shifting this design by three lower surface side wefts. All the warp designs constituting the lower surface side complete design are the same. In other words, a pair of warp binding yarns also forms a lower surface side surface design similar to that formed by a lower surface side warp. Pairs of a warp binding yarn and a lower surface side warp and pairs of a warp binding yarn and an upper surface side warp each forms a lower surface side surface design similar to that formed by a lower surface side warp.

No particular limitation is imposed on the upper surface side complete design composed of warp binding yarns, upper surface side warps and upper surface side wefts. The warp binding yarns forming a pair may be woven with respective upper surface side wefts and cooperatively function as one warp constituting the upper surface side complete design. This also applies to a pair of a warp binding yarn and an upper surface side warp and they may cooperatively function as a warp constituting the upper surface side complete design. In the case of the pair of a warp binding yarn and a lower surface side warp, the lower surface side warp is not woven with an upper surface side weft so that only the warp binding yarn may be woven with an upper surface side weft to function as a warp. One or more than one warp complete design may form the upper surface side complete design. For example, the upper surface side complete design may be formed by a 1/3 design in which an upper surface side warp passes over one upper surface side weft and then passes under three successive upper surface side wefts, a 2/2 design in which an upper surface side warp passes over two upper surface side wefts and passes under two successive upper surface side wefts, or may have a mixture of both the 1/3 design and 2/2 design on one upper surface side surface. Additional examples of the upper surface side surface design include 2-shaft plain weave, 4-shaft twill weave, 4-shaft broken twill weave, 5-shaft twill weave, 5-shart broken twill weave, 10-shaft twill weave and 10-shaft broken twill weave. Any other designs can be selected as needed.

One or more than one auxiliary weft may be placed between upper surface side wefts. The auxiliary weft, together with an upper surface side weft, forms the upper surface side surface design, fills the space between the upper surface side wefts, thereby improving the fiber supporting property, and flattens the irregularities formed by a weft knuckle, thereby improving the surface property. No particular limitation is imposed on the design formed by the auxiliary weft and it can be selected depending on the application or using purpose. In order to improve the fiber supporting property, it is recommended to adopt a design in which a long crimp of auxiliary wefts is formed between upper surface side wefts. No particular limitation is imposed on the diameter of the auxiliary weft, but it has preferably a smaller diameter than an upper surface side weft. Although no particular limitation is imposed on the ratio of auxiliary wefts, a ratio of upper surface side wefts and auxiliary wefts may be 1:1, 2:1, 3:2 or the like.

Although no particular limitation is imposed on the arrangement ratio of warp binding yarns, it is necessary to place at least one warp binding yarn because it serves as a binding yarn. The fabric of the present invention is composed of ten pairs of warps having ten upper surface side warps and ten lower surface side warps arranged vertically. For example, five pairs of an upper surface side warp and a lower surface side warp, out of ten pairs, may be replaced with pairs of warp binding yarns and the pairs of an upper surface side warp and a lower surface side warp may be arranged alternately; or the pairs of a warp binding yarn and a lower surface side warp and the pairs of an upper surface side warp and a lower surface side warp may be arranged at a ratio of 2:3. The number of warp binding yarns may be increased to improve the binding strength. The ratio of warp binding yarns can be selected as needed, depending on the weaving conditions, using purpose, or the like.

A ratio of an upper surface side weft and a lower surface side weft may be 2:1, 1:1, 3:2 or the like. At 2:1 or 3:2 which means dense arrangement of upper surface side wefts and rough arrangement of lower surface side wefts, the fabric has improved wear resistance, because the diameter of the lower surface side weft can be increased easily.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, shenille yarn and yarns obtained by intertwining them. As the cross-section of the yarn, not only circular form but also square or short form such as stellar form, or elliptical or hollow form can be used. The material of the yarn can be selected freely and usable examples of it include polyester, nylon, polyphenylene sulfide, polyvinylidene fluoride, ethylene tetrafluoride, polypropylene, aramid, polyether ether ketone, polyethylene naphthalate, cotton, wool and metal. Of course, yarns obtained using copolymers or incorporating or mixing the above-described material with a substance selected depending on the intended purpose may be used.

As the upper surface side warps, lower surface side warps, upper surface side wefts and warp binding yarns, use of a polyester monofilament having rigidity and excellent dimensional stability is usually preferred. Lower surface side wefts which need wear resistance are able to have improved wear resistance without losing its rigidity, by arranging polyester monofilaments and polyamide monofilaments alternately and interweaving them.

It is also possible to place a plurality of yarns with the same design at a position where one yarn is normally placed in consideration of the design. Improvement in surface property and thinning of the fabric can be attained by arranging a plurality of yarns having a small diameter.

EXAMPLES

Examples of the present invention will hereinafter be described based on accompanying drawings.

FIGS. 1, 4, 7, 10, 13, 16, 19, 22, 25 and 28 are design diagrams illustrating the complete design of the examples of the present invention. The term "complete design" as used herein means a minimum repeating unit of a fabric design and a whole fabric design is formed by connecting this complete design longitudinally and latitudinally. In these design diagrams, warps are indicated by Arabic numerals, for example 1, 2 and 3, while wefts are indicated by Arabic numerals with a prime, for example, 1', 2' and 3'.

In these diagrams, a mark "x" means that an upper surface side warp lies over an upper surface side weft; a mark "□" indicates that a lower surface side warp lies under a lower surface side weft; a mark "●" indicates that a warp binding yarn lies over an upper surface side weft; a mark "○" indicates that a warp binding yarn lies under a lower surface side weft; a mark "◆" indicates that a warp binding yarn lies over an upper surface side weft; and a mark "◇" indicates that a warp binding yarn lies under a lower surface side weft.

Upper surface side warps and wefts have thereunder lower surface side warps and wefts, respectively. In the design diagram, yarns are vertically overlapped precisely and upper surface side warps and wefts have, rightly thereunder, lower surface side warps and wefts, respectively. They are drawn as such for convenience of drawing and misalignment is allowed in the actual fabric.

Example 1

Figure 2A:
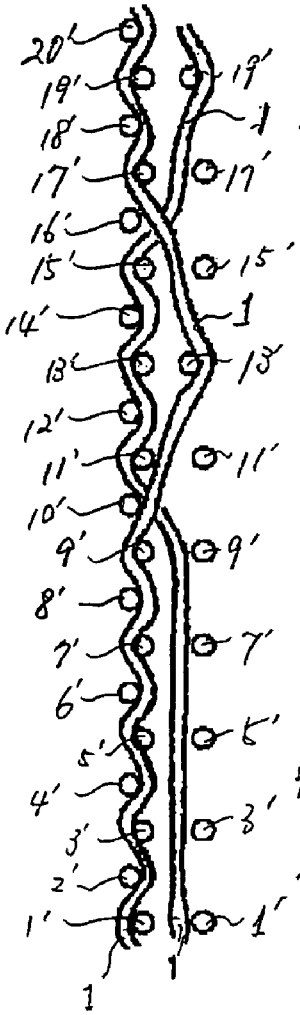
FIGS. 2A and 2B are cross-sectional views taken along warps 1 and 2 of FIG. 1 respectively.
Figure 2B:
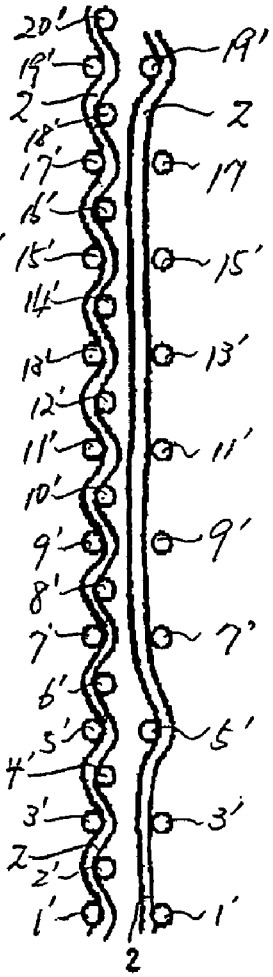
Figure 3:
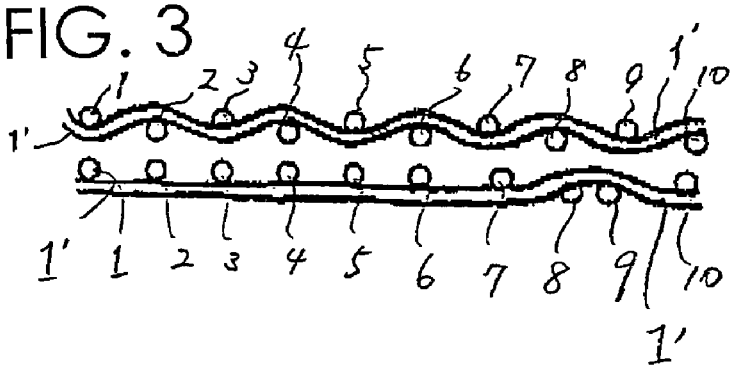
FIG. 3 is a cross-sectional view taken along weft 1' of FIG. 1.

FIG. 1 is a design diagram showing the complete design of Example 1 of the present invention. FIGS. 2A and 2B are cross-sectional views taken along warps 1 and 2 of FIG. 1 respectively. FIG. 3 is a cross-sectional view taken along weft 1' of FIG. 1.

In the diagram of FIG. 1, warps indicated by 2, 4, 6, 8 and 10, of ten pairs of an upper surface side warp and a lower surface side warp arranged vertically, are pairs of an upper surface side warp forming an upper surface side surface and a lower surface side warp forming a lower surface side surface arranged vertically, while warps indicated by 1, 3, 5, 7 and 9 are pairs of two warp binding yarns which are woven with upper surface side wefts and lower surface side wefts to form a portion of an upper surface side surface design and a portion of a lower surface side surface design. Wefts indicated by 1', 2', 3' . . . 20' are upper surface side wefts and lower surface side wefts. The lower surface side wefts are located below the upper surface side wefts of the odd number 1', 3', 5', . . . 19', meaning that their density is half of that of the upper surface side wefts. Warp binding yarns weave an upper surface side layer with a lower surface side layer and they do not destroy the surface design, because they complement each other to form the upper surface side surface design and lower surface side surface design. A pair of two warp binding yarns and a pair of an upper surface side warp and a lower surface side warp are located alternately one by one.

A warp forming the lower surface side has a 6/1-2/1 design in which it passes over six successive lower surface side wefts, passes under one lower surface side weft, passes over two successive lower surface side wefts and passes under one lower surface side weft. Described specifically, a lower surface side warp 2 passes over six successive lower surface side wefts 7', 9', 11', 13', 15' and 17', passes under one lower surface side weft 19', passes over two successive lower surface side wefts 1' and 3' and passes under one lower surface side weft 5'.

One of warp binding yarns forming a pair is woven with at least one upper surface side weft to form the upper surface side surface design, under which the other warp binding yarn is woven with one lower surface side weft, while the one warp binding yarn is woven with one lower surface side weft, over which the other warp binding yarn is woven with at least one upper surface side weft to form the upper surface side surface design. The lower surface side surface design is similar to the 6/1-2/1 design formed by a lower surface side warp. For example, one of warp binding yarns 1 forms a plain weave design with upper surface side wefts 1' to 10', passes between lower surface side weft 11' and upper surface side weft, passes under lower surface side weft 13', passes between lower surface side weft 15' and upper surface side weft and then form a plain weave design with upper surface side warps 17' to 20'. The other one passes between lower surface side wefts 1', 3', 5', 7' and 9' and upper surface side wefts, forms a plain weave design with upper surface side wefts 11' to 16', passes between lower surface side weft 17' and upper surface side weft, and then passes under lower surface side weft 19'. One of warp binding yarns 1 forming a pair is woven with upper surface side wefts 11' to 16', under which the other warp binding yarn is woven with one lower surface side weft 13', while the one warp binding yarn is woven with one lower surface side weft 19', over which the other warp binding yarn is woven with upper surface side wefts 17' to 20' and 1' to 10'. Thus, two warp binding yarns forming a pair cooperatively form a plain weave design as the upper surface side surface design and, as the lower surface side surface design, a 6/1-2/1 design in which warp binding yarn passes over six successive lower surface side wefts, passes under one lower surface side weft, passes over two successive lower surface side wefts and then passes under one lower surface side weft. This upper surface side surface design is similar to the plain weave design formed by another upper surface side warp and upper surface side weft, while this lower surface side surface design is similar to the 6/1-2/1 design formed by another lower surface side warp and lower surface side weft.

In this example, the lower surface side warp 2 has a similar design to that formed by the warp binding yarn 1 except that it is shifted by three lower surface side wefts. The warp binding yarn 3 has a similar design to that formed by the lower surface side warp 2 except that it is shifted by three lower surface side wefts. By sequentially arranging the design in such a manner, a lower surface side warp and a warp binding yarn which are adjacent to each other simultaneously weave therein one lower surface side weft from the lower surface side, whereby the resulting fabric has improved rigidity. In addition, on the lower surface side surface, a weft long crimp of a lower surface side weft corresponding to eight lower surface side warps is formed so that the fabric has improved wear resistance. The warp binding yarn 1 and lower surface side warp 2 which are adjacent to each other simultaneously weave one lower surface side weft 19' from the lower surface side surface so that the lower surface side weft 19' passes over the warp binding yarn 1 and lower surface side warp 2, and then passes under eight successive lower surface side warps and warp binding yarns, 3, 4, 5, 6, 7, 8, 9 and 10.

Simultaneous weaving of a lower surface side warp and a warp binding yarn by one lower surface side weft from the lower surface side brings them close to each other. A lower surface side warp and a warp binding yarn are woven by a lower surface side weft twice. The lower surface side warp is woven once with each of two warp binding yarns, which are on both adjacent sides thereto, simultaneously so that it is brought into contact with them alternately and is placed in a zigzag arrangement. The other warp binding yarn is also woven once with each of two lower surface side warps, which are on both adjacent sides thereto, simultaneously so that it is brought into contact with them alternately and is arranged in a zigzag manner. Accordingly, warp-direction yarns constituting the lower surface side layer are placed in a zigzag arrangement.

The above-described zigzag arrangement will next be described with the warp binding yarn 3 and lower surface side warp 4 as examples. The lower surface side warp 2 and warp binding yarn 3 are woven simultaneously by the lower surface side weft 5' from the lower surface side, which brings the lower surface side warp 2 and warp binding yarn 3 close to each other, while the warp binding yarn 3 and the lower surface side warp 4 are woven simultaneously by the lower surface side weft 11', which brings the warp binding yarn 3 and lower surface side warp 4 close to each other. By this, the warp binding yarn 3 gets close to the lower surface side warp 2 at the intersection with the lower surface side weft 5' and gets close to the warp binding yarn 4 at the intersection with the lower surface side weft 11'. The warp binding yarn 3 is thus placed in a zigzag arrangement by repeating this.

With regard to the lower surface side warp 4, the lower surface side warp 4 and the warp binding yarn 5 are woven simultaneously by the lower surface side weft 17' from the lower surface side, which brings the lower surface side warp 4 and warp binding yarn 5 close to each other, while the warp binding yarn 3 and lower surface side warp 4 are simultaneously woven by the lower surface side weft 11' from the lower surface side which brings the warp binding yarn 3 and lower surface side warp 4 closer to each other. By this, the lower surface side warp 4 gets close to the warp binding yarn 5 at the intersection with the lower surface side weft 17' and gets close to the warp binding yarn 3 at the intersection with the lower surface side weft 11'. The lower surface side warp 4 is thus placed in a zigzag arrangement by repeating this. The other lower surface side warps and warp binding yarns are also placed in a zigzag arrangement, while being brought into contact alternately, which suggests that warp-direction yarns constituting the lower surface side layer are placed in a zigzag arrangement. An overlapped portion and a non-overlapped portion between a warp-direction yarn constituting the upper surface side layer and a warp-direction yarn constituting the lower surface side layer are therefore caused to exist as a mixture by employing such a zigzag arrangement. By this, the water drainage property becomes irregular, which enables stepwise dehydration and makes it possible to inhibit generation of dehydration marks, sticking of a sheet raw material on a wire and loss of fiber or filler, or to improve rigidity in a diagonal direction.

In the upper surface side layer, an upper surface side warp has a plain weave design in which it passes over one upper surface side weft, and then passes under one upper surface side weft. A warp binding yarn adjacent to the upper surface side warp has a similar plain weave design except that it is shifted by one upper surface side weft. The upper surface side warp 2 has a plain weave design in which it passes over one upper surface side weft 2' and then passes under one upper surface side weft 3'. Also a plain weave design is employed as the upper surface side surface design formed by a pair of warp binding yarns 1. The other upper surface side warps and warp binding yarns also have a plain weave design. It is thus possible to form a uniform surface by employing the same design for the upper surface side design formed by upper surface side warps and the upper surface side design formed by warp binding yarns. In this example, a plain weave design is employed as the upper surface side design. There is no particular limitation on it and any design can be selected as desired.

By employing the above-described design of the present invention, the resulting fabric is able to have improved rigidity, diagonal rigidity, wear resistance and surface property, and in addition, generation of dehydration marks, sticking of a sheet raw material on a wire and loss of fiber or filler can be inhibited.

Example 2

Figure 4:
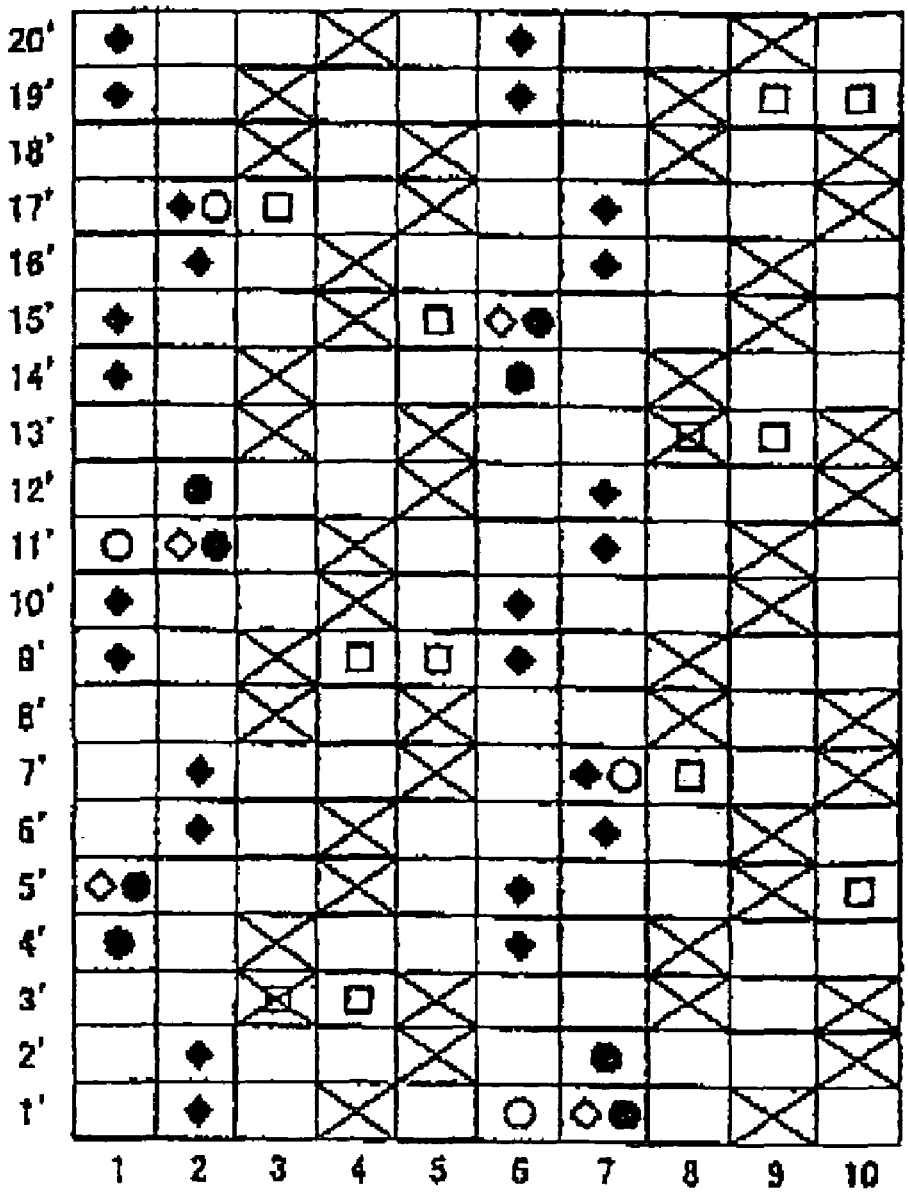
FIG. 4 is a design diagram illustrating the complete design of Example 2 of the present invention.
Figures 5A, 5B:
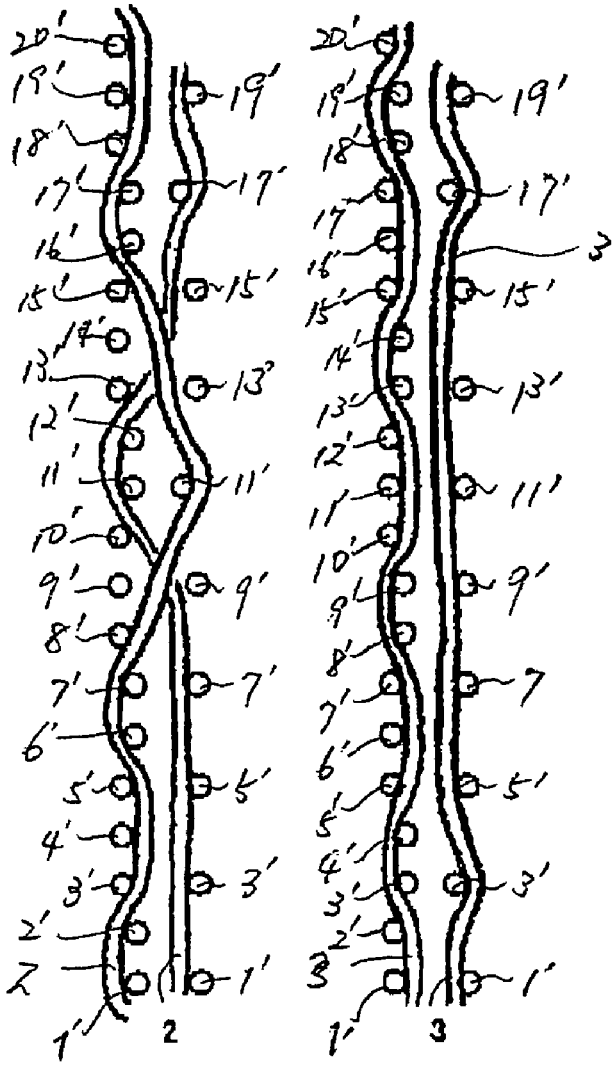
FIGS. 5A and 5B are cross-sectional views taken along warps 2 and 3 of FIG. 4 respectively.
Figure 6:
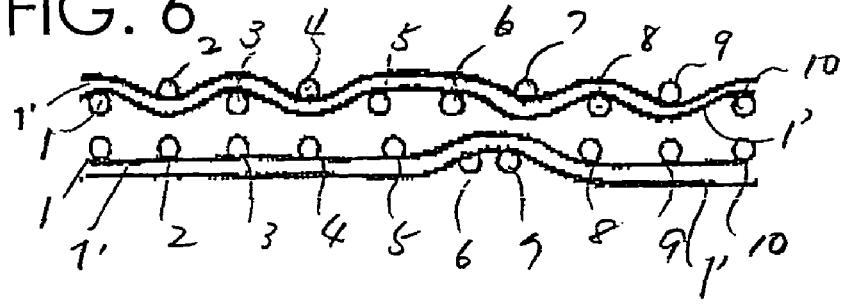
FIG. 6 is a cross-sectional view taken along weft 1' of FIG. 4.

FIG. 4 is a design diagram illustrating the complete design of Example 2 of the present invention. FIGS. 5A and 5B are cross-sectional views taken along warps 2 and 3 of FIG. 4 respectively. FIG. 6 is a cross-sectional view taken along weft 1' of FIG. 4.

In the design diagram of FIG. 4, of ten pairs of an upper surface side warp and lower a surface side warp vertically arranged, pairs indicated by 3, 4, 5, 8, 9 and 10 are those of an upper surface side warp and a lower surface side warp and pairs indicated by 1, 2, 6 and 7 are those of warp binding yarns. Pairs of warp binding yarns and pairs of an upper surface side warp and a lower surface side warp are arranged at a ratio of 2:3. Upper surface side wefts and lower surface side wefts are arranged at a ratio of 2:1. Similar to Example 1, warp binding yarns are yarns for weaving the upper surface side layer and lower surface side layer. Warp binding yarns as a pair complement each other to form the upper surface side surface design and the lower surface side surface design so that they do not destroy the surface design. Since a 2/3 design is employed for the upper surface side layer, a long crimp is formed in a weft direction and therefore the fabric is able to have improved fiber supporting property.

Example 3

Figure 7:
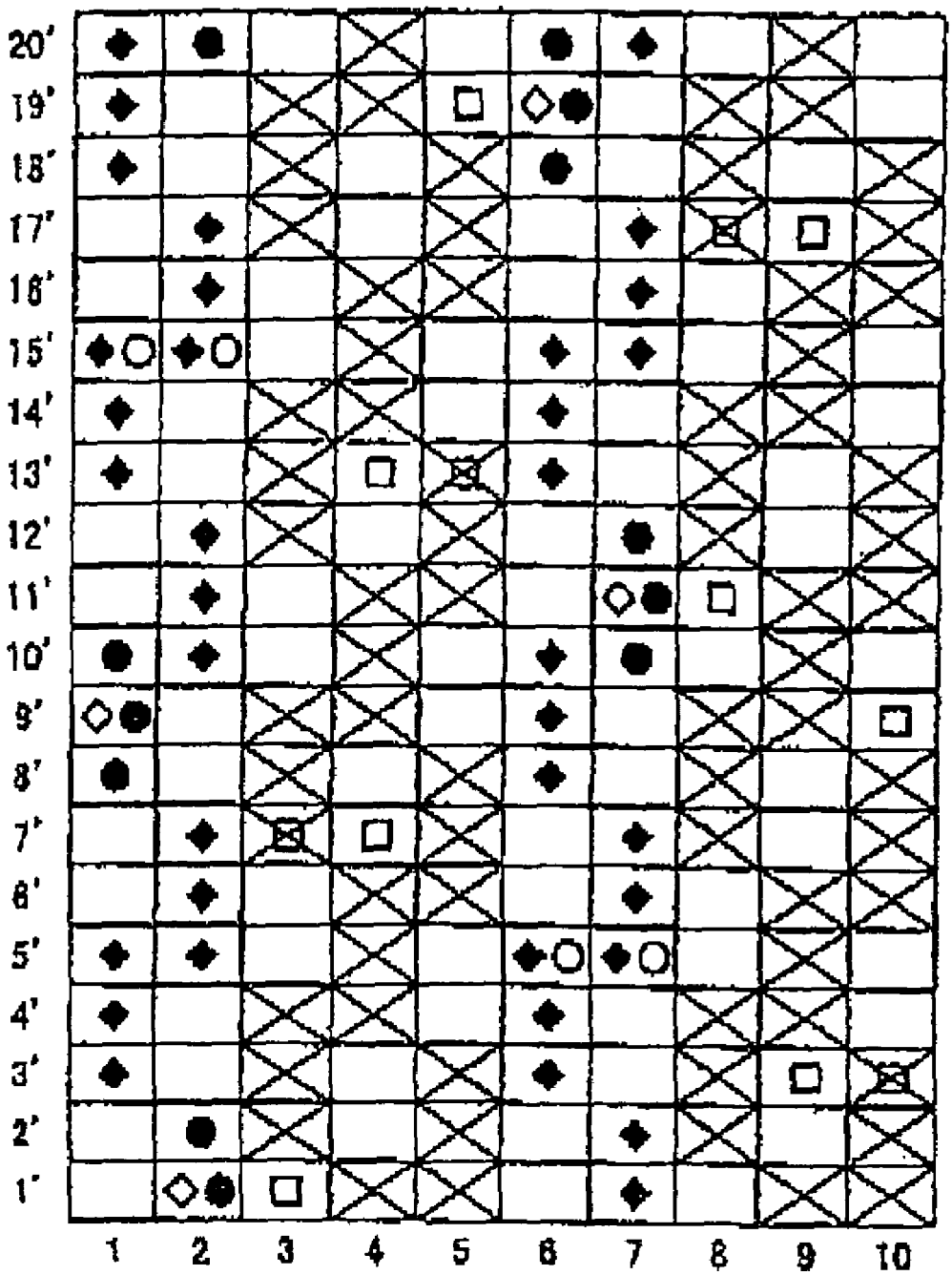
FIG. 7 is a design diagram illustrating the complete design of Example 3 of the present invention.
Figures 8A, 8B:
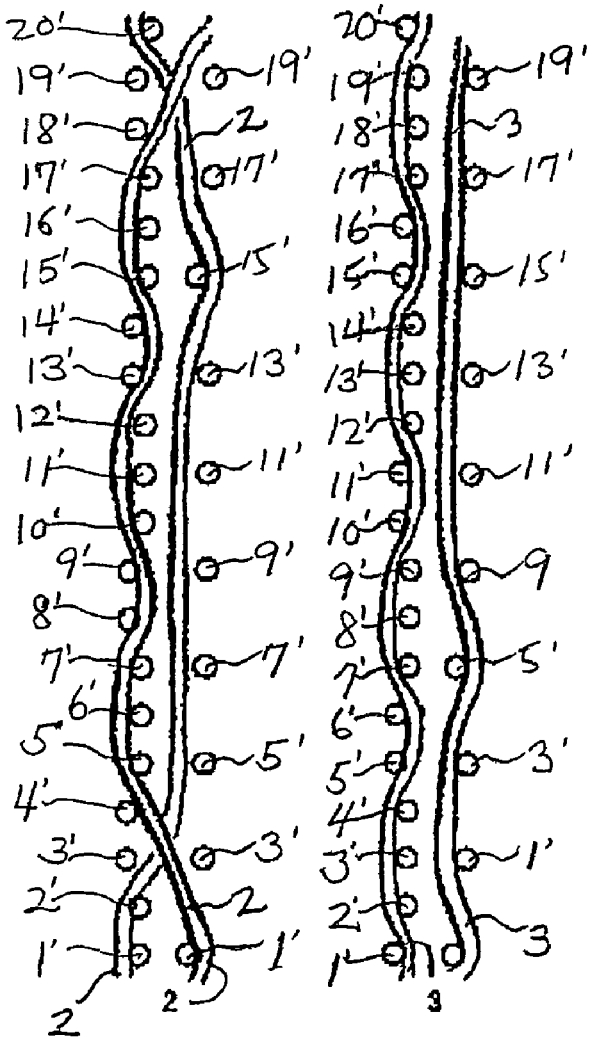
FIGS. 8A and 8B are cross-sectional views taken along warps 2 and 3 of FIG. 7 respectively.
Figure 9:
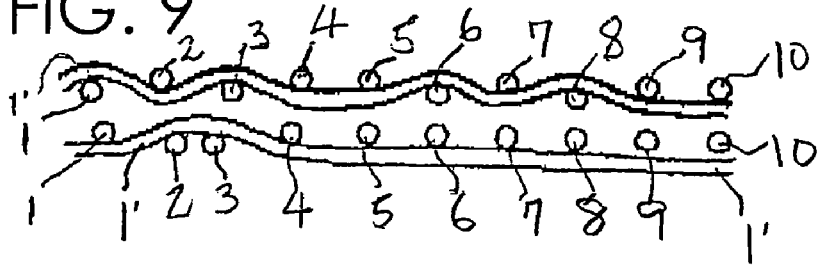
FIG. 9 is a cross-sectional view taken along weft 1' of FIG. 7.

FIG. 7 is a design diagram illustrating the complete design of Example 3 of the present invention. FIGS. 8A and 8B are cross-sectional views taken along warps 2 and 3 of FIG. 7 respectively. FIG. 9 is a cross-sectional view taken along weft 1' of FIG. 7.

In the diagram of FIG. 7, of ten pairs of an upper surface side warp and a lower surface side warp vertically arranged, pairs indicated by 3, 4, 5, 8, 9 and 10 are those of an upper surface side warp and a lower surface side warp, and pairs indicated by 1, 2, 6 and 7 are those of warp binding yarns. Pairs of warp binding yarns and pairs of an upper surface side warp and a lower surface side warp are arranged at a ratio of 2:3. Upper surface side wefts and lower surface side wefts are arranged at a ratio of 2:1. A 3/2 design is adopted for the upper surface side layer so that a long crimp is formed in the weft direction. Such a design can be employed as the upper surface side surface design according to the intended use or application.

Example 4

Figure 10:
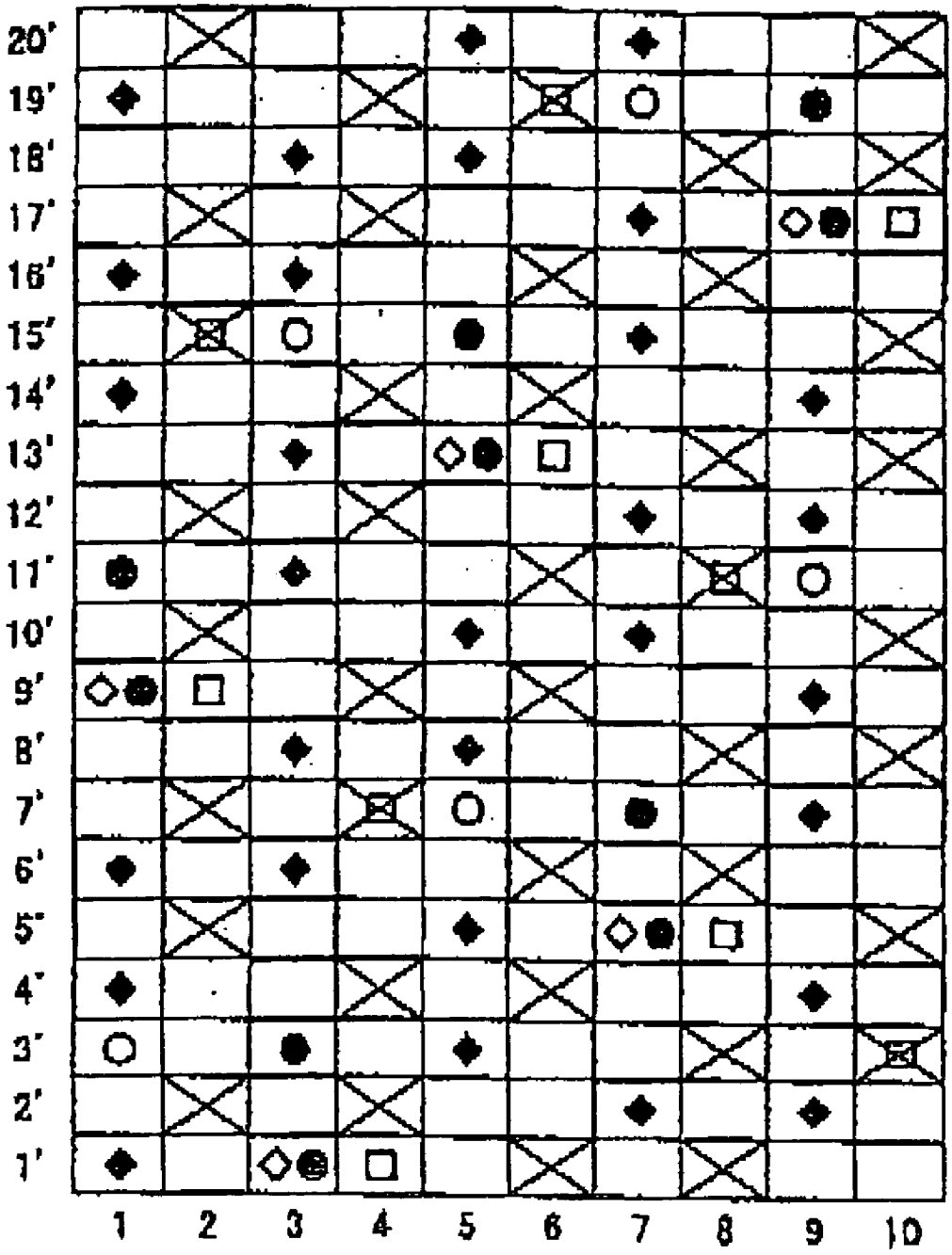
FIG. 10 is a design diagram illustrating the complete design of Example 4 of the present invention.
Figure 11A:
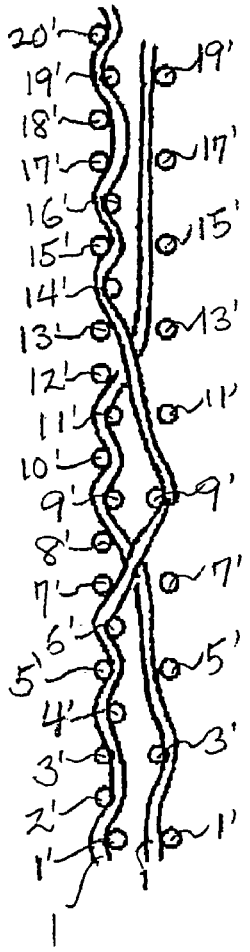
FIGS. 11A and 11B are cross-sectional views taken along warps 1 and 2 of FIG. 10 respectively.
Figure 11B:
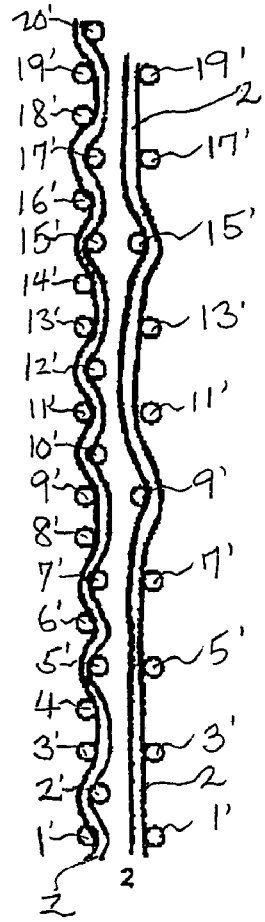
Figure 12:
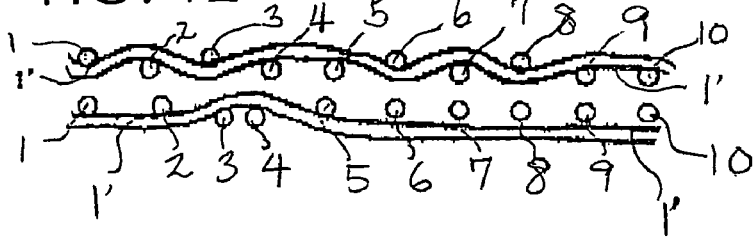
FIG. 12 is a cross-sectional view taken along weft 1' of FIG. 10.

FIG. 10 is a design diagram illustrating the complete design of Example 4 of the present invention. FIGS. 11A and 11B are cross-sectional views taken along warps 1 and 2 of FIG. 10 respectively. FIG. 12 is a cross-sectional view taken along weft 1' of FIG. 10.

In the diagram of FIG. 10, of ten pairs of an upper surface side warp and a lower surface side warp vertically arranged, pairs indicated by 2, 4, 6, 8 and 10 are those of an upper surface side warp and a lower surface side warp, and pairs indicated by 1, 3, 5, 7 and 9 are those of warp binding yarns. Pairs of warp binding yarns and pairs of an upper surface side warp and a lower surface side warp are arranged alternately. Upper surface side wefts and lower surface side wefts are arranged at a ratio of 2:1. Warp-direction yarns constituting the upper surface side layer are formed by repeating a design in which it passes over one upper surface side weft, passes under two upper surface side wefts, passes over one upper surface side weft and passes under one upper surface side weft. Such a design can be employed as the upper surface side surface design according to the intended use or application.

Example 5

Figure 13:
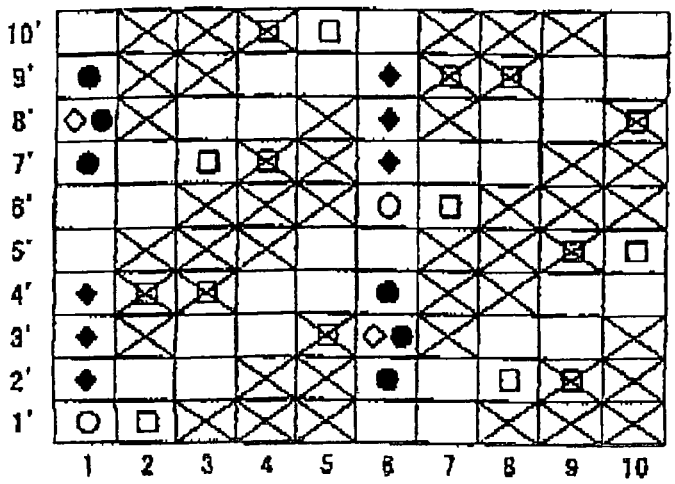
FIG. 13 is a design diagram illustrating the complete design of Example 5 of the present invention.
Figures 14A, 14B:
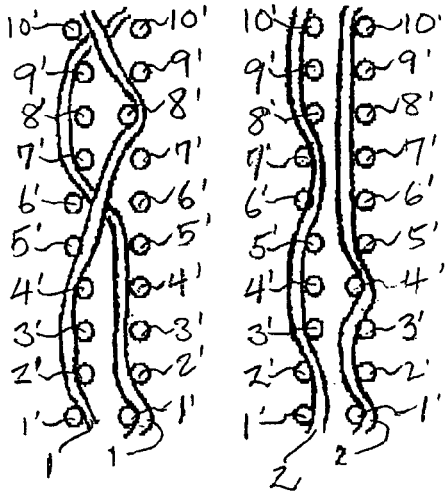
FIGS. 14A and 14B are cross-sectional views taken along warps 1 and 2 of FIG. 13 respectively.
Figure 15:
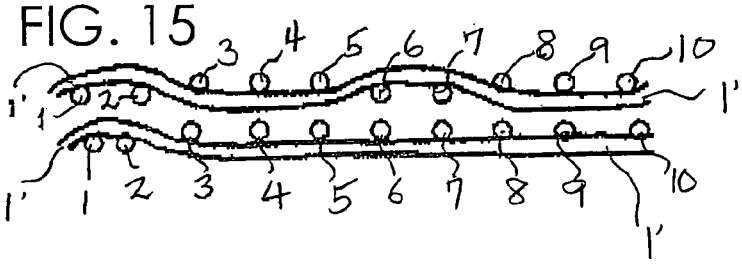
FIG. 15 is a cross-sectional view taken along weft 1' of FIG. 13.

FIG. 13 is a design diagram illustrating the complete design of Example 5 of the present invention. FIGS. 14A and 14B are cross-sectional views taken along warps 1 and 2 of FIG. 13 respectively. FIG. 15 is a cross-sectional view taken along weft 1' of FIG. 13.

In the design diagram of FIG. 13, of ten pairs of an upper surface side warp and a lower surface side warp vertically arranged, pairs indicated by 2, 3, 4, 5, 7, 8, 9 and 10 are those of an upper surface side warp and a lower surface side warp and pairs indicated by 1 and 6 are those of warp binding yarns. Pairs of two warp binding yarns. Upper surface side wefts and lower surface side wefts are arranged at a ratio of 1:1. The upper surface side layer has a 3/2 design. Although pairs of warp binding yarns and pairs of an upper surface side warp and a lower surface side warp are arranged at 1:4, the fabric still has enough binding power.

Example 6

Figure 16:
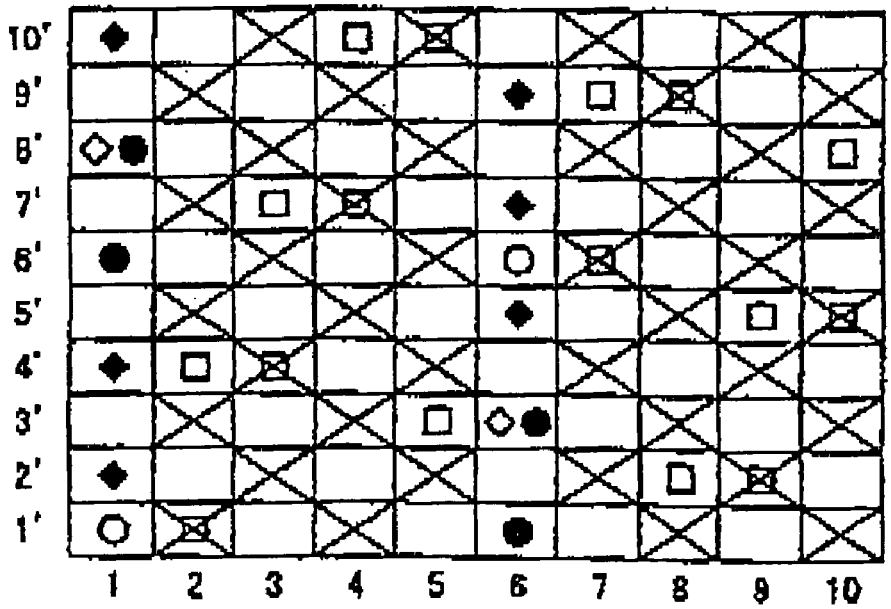
FIG. 16 is a design diagram illustrating the complete design of Example 6 of the present invention.
Figures 17A, 17B:
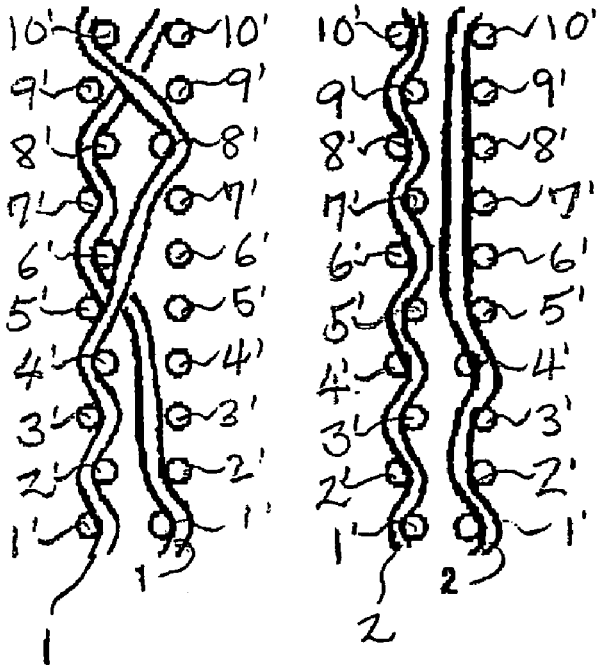
FIGS. 17A and 17B are cross-sectional views taken along warps 1 and 2 of FIG. 16 respectively.
Figure 18:
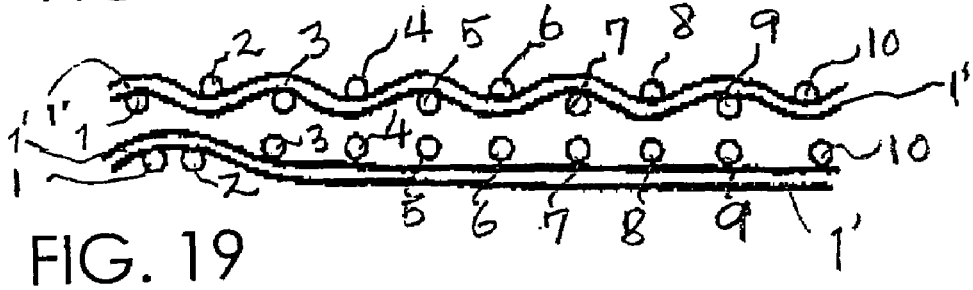
FIG. 18 is a cross-sectional view taken along weft 1' of FIG. 16.

FIG. 16 is a design diagram illustrating the complete design of Example 6 of the present invention. FIGS. 17A and 17B are cross-sectional views taken along warps 1 and 2 of FIG. 16 respectively. FIG. 18 is a cross-sectional view taken along weft 1' of FIG. 16.

In the design diagram of FIG. 16, of ten pairs of an upper surface side warp and a lower surface side warp vertically arranged, pairs indicated by 2, 3, 4, 5, 7, 8, 9 and 10 are an upper surface side warp and a lower surface side warp and pairs indicated by 1 and 6 are warp binding yarns. Pairs of two warp binding yarns and pairs of an upper surface side warp and a lower surface side warp are arranged at a ratio of 1:4. Upper surface side wefts and lower surface side wefts are arranged at a ratio of 1:1. Since a plain weave design is employed for the upper surface side layer. As a result, the fabric has improved rigidity, diagonal rigidity and surface property, and generation of dehydration marks, sticking of a sheet raw material on a wire, loss of fiber or filler can be inhibited.

Example 7

Figure 19:
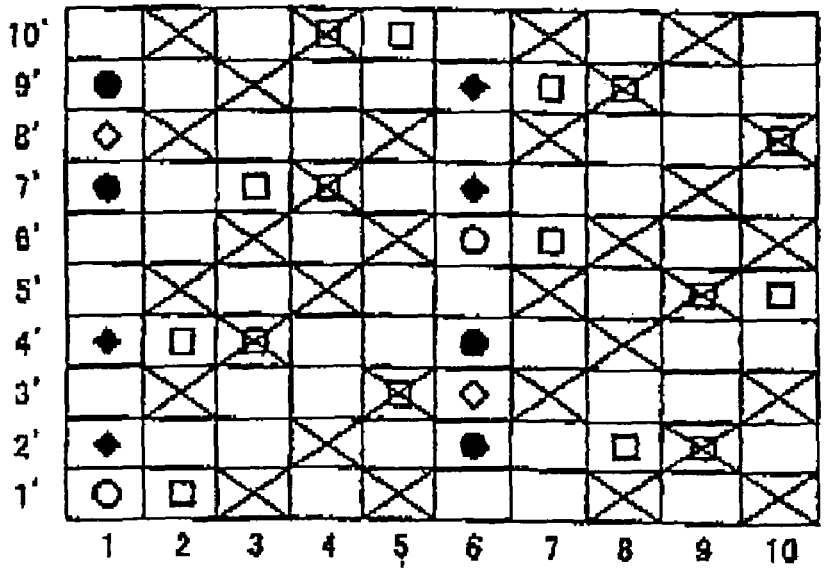
FIG. 19 is a design diagram illustrating the complete design of Example 7 of the present invention.
Figures 20A, 20B:
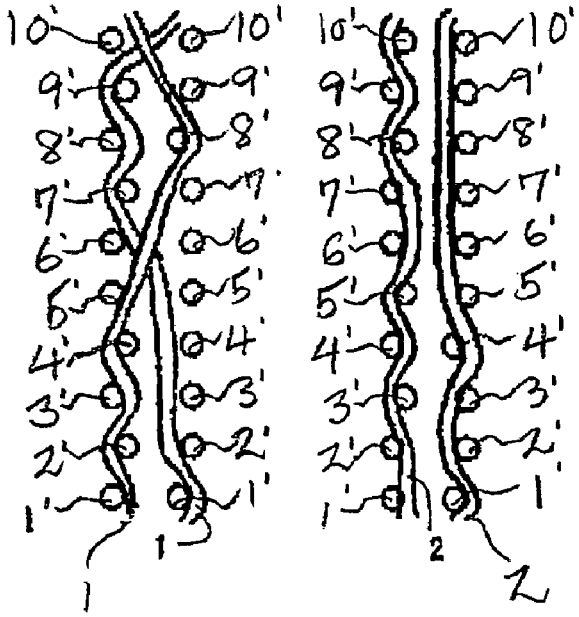
FIGS. 20A and 20B are cross-sectional views taken along warps 1 and 2 of FIG. 19 respectively.
Figure 21:
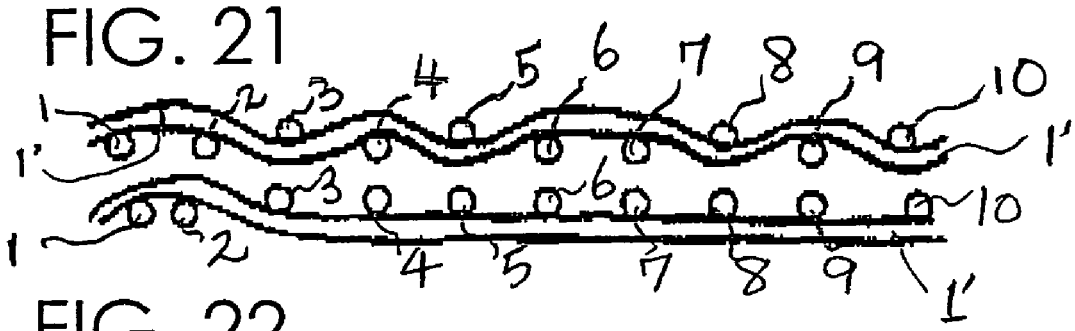
FIG. 21 is a cross-sectional view taken along weft 1' of FIG. 19.

FIG. 19 is a design diagram illustrating the complete design of Example 7 of the present invention. FIGS. 20A and 20B are cross-sectional views taken along warps 1 and 2 of FIG. 19 respectively. FIG. 21 is a cross-sectional view taken along weft 1' of FIG. 19.

In the diagram of FIG. 19, of ten pairs of an upper surface side warp and a lower surface side warp vertically arranged, pairs indicated by 2, 3, 4, 5, 7, 8, 9 and 10 are those of an upper surface side warp and a lower surface side warp, pairs indicated by 1 and 6 are and those of warp binding yarns. Pairs of warp binding yarns and pairs of an upper surface side warp and a lower surface side warp are arranged at a ratio of 1:4. Upper surface side wefts and lower surface side wefts are arranged at a ratio of 1:1. Warp-direction yarns constituting the upper surface side layer are formed by repeating a design in which one upper surface side warp passes over one upper surface side weft, passes under two upper surface side wefts, passes over one upper surface side weft and then passes under one upper surface side weft. Such a design can be employed as the upper surface side surface design, depending on the intended use or applications.

Example 8

Figure 22:
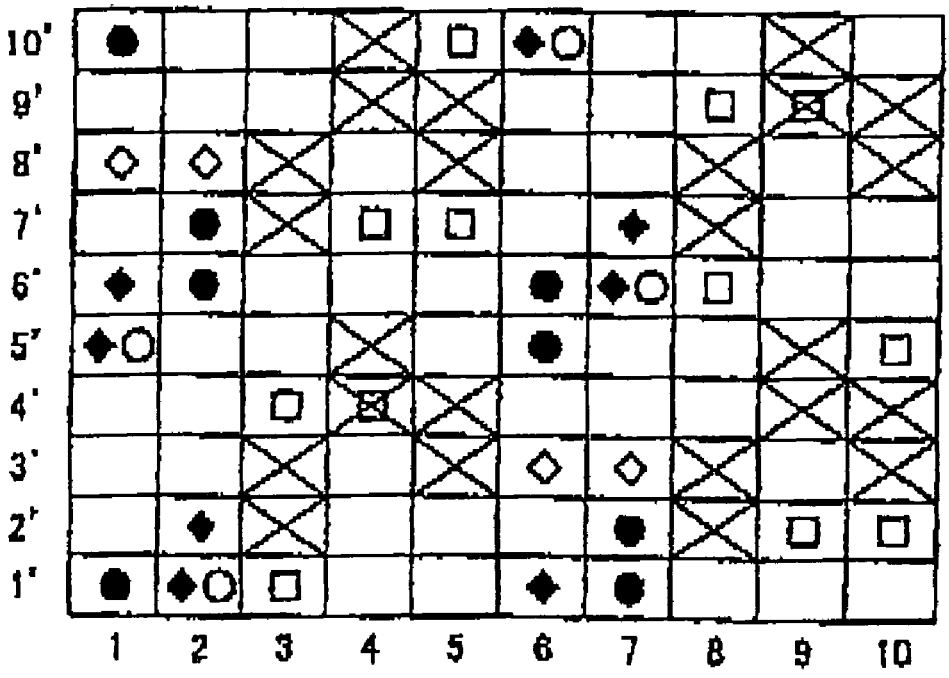
FIG. 22 is a design diagram illustrating the complete design of Example 8 of the present invention.
Figures 23A, 23B:
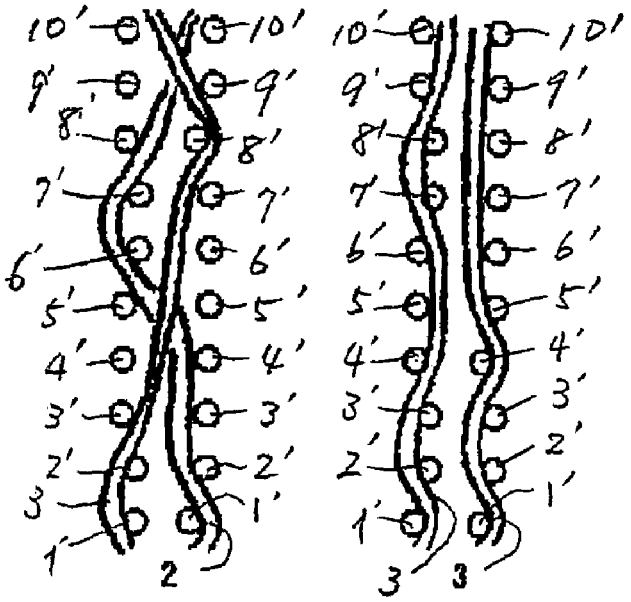
FIGS. 23A and 23B are cross-sectional views taken along warps 2 and 3 of FIG. 22 respectively.
Figure 24:
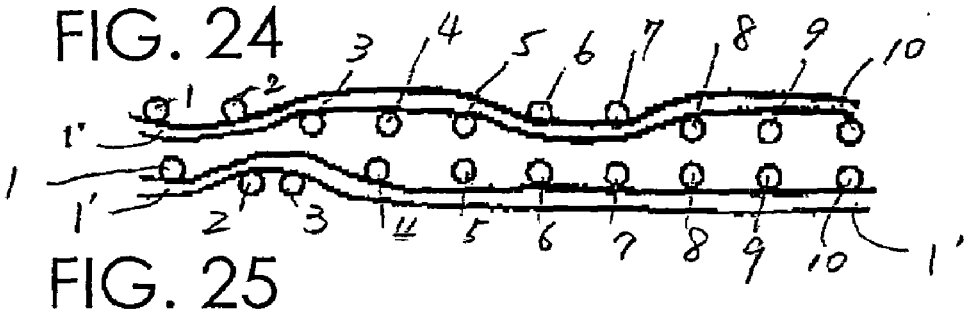
FIG. 24 is a cross-sectional view taken along weft 1' of FIG. 22.

FIG. 22 is a design diagram illustrating the complete design of Example 8 of the present invention. FIGS. 23A and 23B are cross-sectional views taken along warps 2 and 3 of FIG. 22 respectively. FIG. 24 is a cross-sectional view taken along weft 1' of FIG. 22.

In the diagram of FIG. 22, of ten pairs of an upper surface side warp and a lower surface side warp vertically arranged, pairs indicated by 3, 4, 5, 8, 9 and 10 are those of an upper surface side warp and a lower surface side warp, while pairs indicated by 1, 2, 6 and 7 are those of warp binding yarns. Pairs of warp binding yarns and pairs of an upper surface side warp and a lower surface side warp are arranged at a ratio of 2:3. Upper surface side wefts and lower surface side wefts are arranged at a ratio of 1:1. Adoption of a 2/3 design and broken twill weave for its upper surface side layer makes it possible to break the regularity of the upper surface side surface design in the diagonal direction, thereby inhibiting generation of wire marks in the diagonal direction.

Example 9

Figure 25:
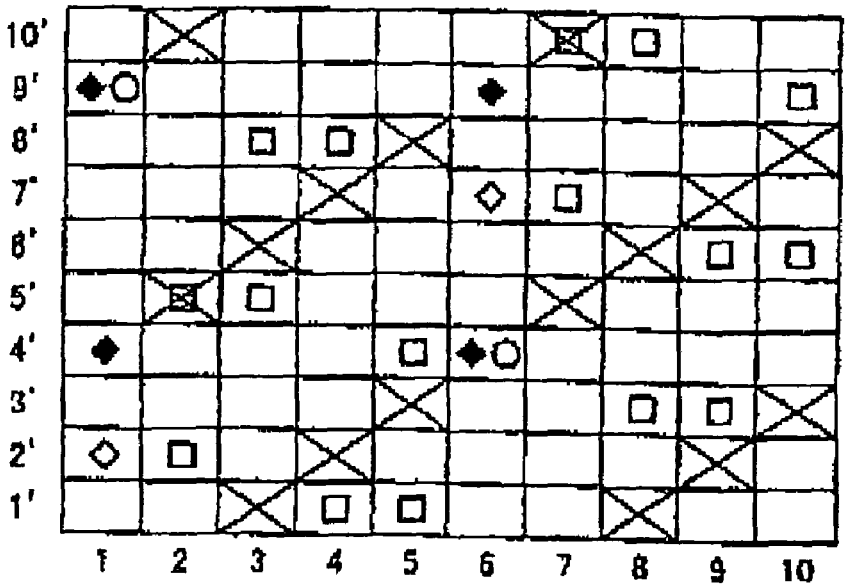
FIG. 25 is a design diagram illustrating the complete design of Example 9 of the present invention.
Figures 26A, 26B:
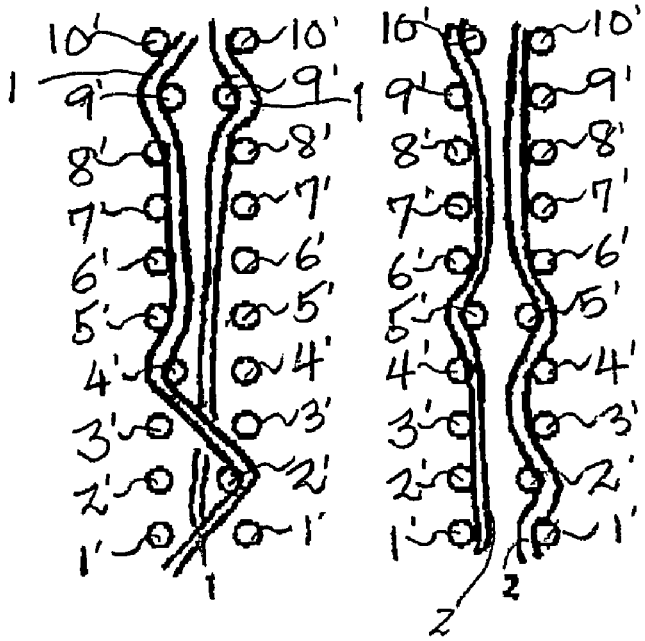
FIGS. 26A and 26B are cross-sectional views taken along warps 1 and 2 of FIG. 25 respectively.
Figure 27:
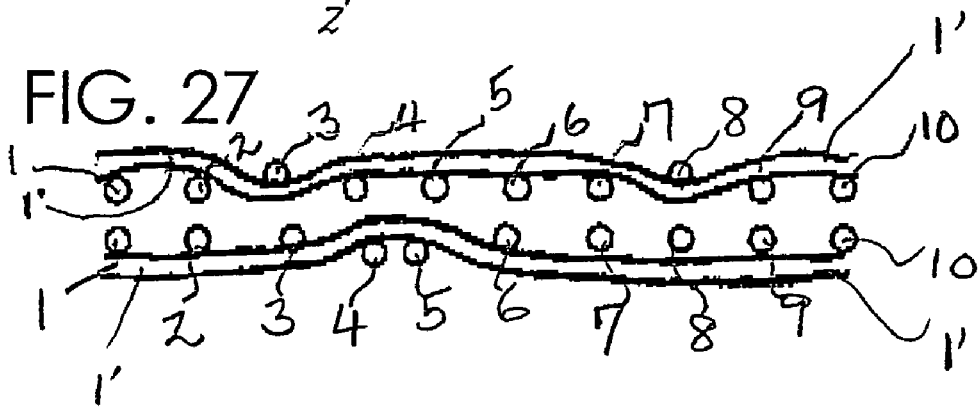
FIG. 27 is a cross-sectional view taken along weft 1' of FIG. 25.

FIG. 25 is a design diagram illustrating the complete design of Example 9 of the present invention. FIGS. 26A and 26B are cross-sectional views taken along warps 1 and 2 of FIG. 25 respectively. FIG. 27 is a cross-sectional view taken along weft 1' of FIG. 25.

In the diagram of FIG. 25, of ten pairs of an upper surface side warp and a lower surface side warp vertically arranged, pairs indicated by 2, 3, 4, 5, 7, 8, 9 and 10 are those of an upper surface side warp and a lower surface side warp, and pairs indicated by 1 and 6 are those of a warp binding yarn, which is used instead of an upper surface side warp, and a lower surface side warp. The upper surface side warps 1 and 6 are each replaced with a warp binding yarn woven with an upper surface side weft and a lower surface side weft to form a portion of the upper surface side surface design and a portion of the lower surface side surface design. In the pair of a warp binding yarn and a lower surface side warp, the warp binding yarn is woven with a upper surface side weft to function as one warp constituting the upper surface side complete design on the upper surface side surface, while on the lower surface side, the warp binding yarn and the lower surface side warp cooperatively form a similar lower surface side surface design to that formed by another lower surface side warp.

In the pair 1 of a warp binding yarn and a lower surface side warp, the warp binding yarn passes over upper surface side weft 4', passes between upper surface side wefts and lower surface side wefts 5', 6', 7' and 8', passes over upper surface side weft 9', passes between upper surface side wefts and lower surface side wefts 10' and 1', and passes under lower surface side weft 2', thereby forming, on the upper surface side surface, a similar upper surface side surface design to that formed by an upper surface side warp. The lower surface side warp of this pair 1 passes over lower surface side wefts 10' and 1' to 8', and passes under lower surface side weft 9'. The lower surface side warp and warp binding yarn cooperatively form, on the lower surface side surface, a similar lower surface side surface design to that formed by another lower surface side warp. The lower surface side warp 2 is arranged by shifting the design formed by the pair 1 of the warp binding yarn and lower surface side warp by three lower surface side wefts. By sequentially arranging the design thus shifted, the lower surface side warp and warp binding yarn which are adjacent to each other simultaneously weave one lower surface side weft therein from the lower surface side. By such a design, the fabric has improved rigidity. In addition, it has improved wear resistance because a weft long crimp of a lower surface side weft corresponding to eight lower surface side warps is formed on the lower surface side surface.

In the pair 1 of a warp binding yarn 1 and a lower surface side warp, and the lower surface side warp 2, the warp binding yarn 1 and lower surface side warp 2, which are adjacent to each other, are woven simultaneously by the lower surface side weft 2' from the lower surface side, which brings the warp binding yarn 1 and lower surface side warp 2 close to each other. The lower surface side warp 2 and the lower surface side warp 3 are simultaneously woven by the lower surface side weft 5' from the lower surface side, which brings the lower surface side warp 2 and the lower surface side warp 3 close to each other. By this, the lower surface side warp 2 gets close to the warp binding yarn 1 at the intersection with the lower surface side weft 2' and gets close to the lower surface side warp 3 at the intersection with the lower surface side weft 5'. The lower surface side warp 2 is thus placed in a zigzag arrangement by repeating this. An overlapped portion and a non-overlapped portion between a warp-direction yarn constituting the upper surface side layer and a warp-direction yarn constituting the lower surface side layer are therefore caused to exist as a mixture by employing such a zigzag arrangement. This causes irregular water drainage, which enables stepwise dehydration and makes it possible to inhibit generation of dehydration marks, sticking of a sheet raw material on a wire and loss of fiber or filler, or to improve rigidity in the diagonal direction.

In this example, pairs of a warp binding yarn and a lower surface side warp and pairs of an upper surface side warp and a lower surface side warp are arranged at a ratio of 1:4. Upper surface side wefts and lower surface side wefts are arranged at a ratio of 1:1. From Example 1 to Example 8, at least one pair of warp binding yarns is placed in the complete design, however, the fabric obtained in this Example does not have a pair of warp binding yarns, but has two pairs of a warp binding yarn and a lower surface side warp. Even if a pair of a warp binding yarn and a lower surface side warp is used as in this Example, the binding power is not impaired at all.

Example 10

Figure 28:
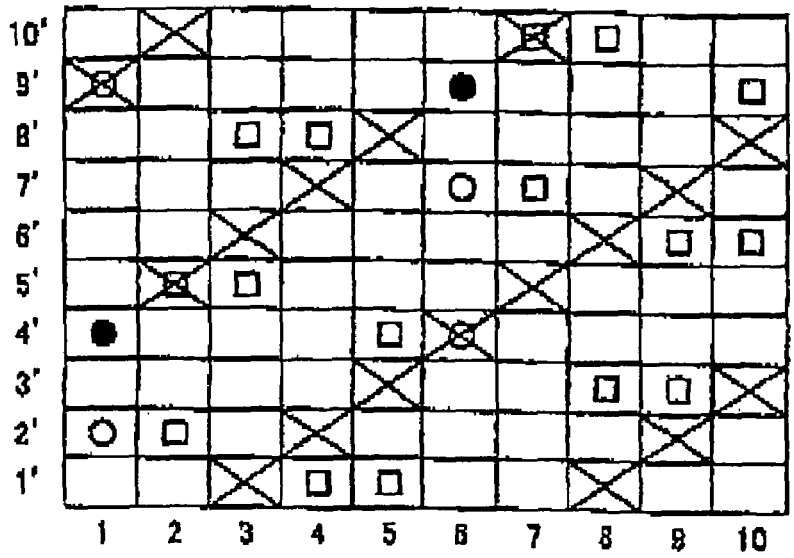
FIG. 28 is a design diagram illustrating the complete design of Example 10 of the present invention.
Figures 29A, 29B:
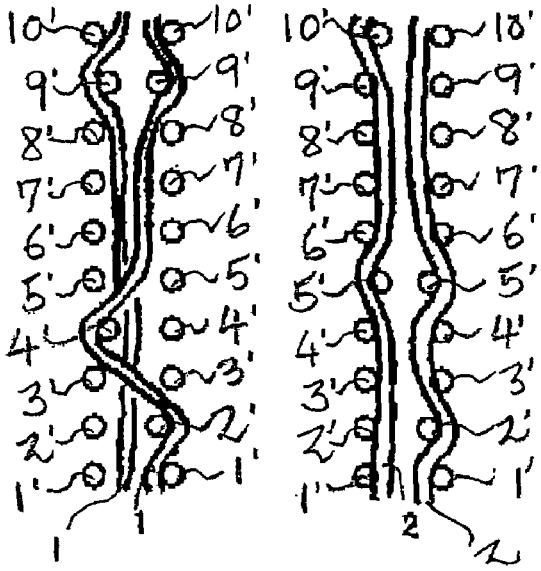
FIGS. 29A and 29B are cross-sectional views taken along warps 1 and 2 of FIG. 28 respectively.
Figure 30:
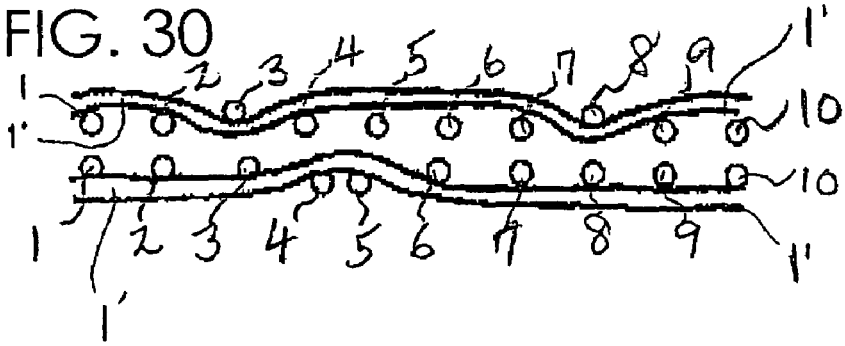
FIG. 30 is a cross-sectional view taken along weft 1' of FIG. 28.

FIG. 28 is a design diagram illustrating the complete design of Example 10 of the present invention. FIGS. 29A and 29B are cross-sectional views taken along warps 1 and 2 of FIG. 28 respectively. FIG. 30 is a cross-sectional view taken along weft 1' of FIG. 28.

In the diagram of FIG. 28, of ten pairs of an upper surface side warp and a lower surface side warp vertically arranged, pairs indicated by 2, 3, 4, 5, 7, 8, 9 and 10 are those of an upper surface side warp and a lower surface side warp and pairs indicated by 1 and 6 are those of a warp binding yarn, which is used instead of a lower surface side warp, and an upper surface side warp. The lower surface side warps 1 and 6 are each replaced with a warp binding yarn woven with an upper surface side weft and a lower surface side weft to form a portion of the upper surface side surface design and a portion of the lower surface side surface design. In the pair of a warp binding yarn and an upper surface side warp, the warp binding yarn and upper surface side warp are woven with respective upper surface side wefts and they cooperatively function as one warp constituting the upper surface side complete design on the upper surface side surface, while on the lower surface side, the warp binding yarn forms a similar lower surface side surface design to that formed by a lower surface side warp.

In the pair 1 of a warp binding yarn and an upper surface side warp, the warp binding yarn passes over upper surface side weft 4', passes between upper surface side wefts and lower surface side wefts 5', 6', 7' and 8', passes under lower surface side weft 9', passes between upper surface side wefts and lower surface side wefts 10' and 1', passes under lower surface side weft 2', and passes between upper surface side weft and lower surface side weft 3'. The upper surface side warp of this pair 1 passes under upper surface side wefts 10' and 1' to 8', and passes over upper surface side weft 9'. The upper surface side warp and warp binding yarn cooperatively form, on the upper surface side surface, a similar upper surface side surface design to that formed by an upper surface side warp. The lower surface side warp 2 is arranged by shifting the design formed by the warp binding yarn 1 by three lower surface side wefts. The lower surface side warp 3 adjacent to the lower surface side warp 2 is arranged by shifting the design of the lower surface side warp 2 by three lower surface side wefts. By sequentially arranging the design thus shifted, the lower surface side warp and warp binding yarn which are adjacent to each other simultaneously weave one lower surface side weft therein from the lower surface side. By such a design, the fabric has improved rigidity. In addition, it has improved wear resistance, because a weft long crimp of a lower surface side weft corresponding to eight lower surface side warps is formed on the lower surface side surface.

In the pair 1 of a warp binding yarn and an upper surface side warp, and the lower surface side warp 2, the warp binding yarn 1 and lower surface side warp 2, which are adjacent to each other, are woven simultaneously by the lower surface side weft 2' from the lower surface side, which brings the warp binding yarn 1 and lower surface side warp 2 close to each other. The lower surface side warp 2 and the lower surface side warp 3 are simultaneously woven by the lower surface side weft 5' from the lower surface side, which brings the lower surface side warp 2 and the lower surface side warp 3 close to each other. By this, the lower surface side warp 2 gets close to the warp binding yarn 1 at the intersection with the lower surface side weft 2' and gets close to the lower surface side warp 3 at the intersection with the lower surface side weft 5'. The lower surface side warp 2 is thus placed in a zigzag arrangement by repeating this. An overlapped portion and a non-overlapped portion between a warp-direction yarn constituting the upper surface side layer and a warp-direction yarn constituting the lower surface side layer are therefore caused to exist as a mixture by employing such a zigzag arrangement. This causes water drainage irregular, which enables stepwise dehydration and makes it possible to inhibit generation of dehydration marks, sticking of a sheet raw material on a wire and loss of fiber or filler, or to improve rigidity in the diagonal direction.

In this example, pairs of a warp binding yarn and an upper surface side warp and pairs of an upper surface side warp and a lower surface side warp are arranged at a ratio of 1:4. Upper surface side wefts and lower surface side wefts are arranged at a ratio of 1:1. Similar to Example 9, the fabric of this example has two pairs of a warp binding yarn and an upper surface side warp instead of pairs of warp binding yarns. Even if a pair of a warp binding yarn and an upper surface side warp is used as in this example, the binding power is not impaired at all.

The industrial two-layer fabric according to the present invention has excellent rigidity, diagonal rigidity and wear resistance so that it is suited for use in many fields such as papermaking and filter cloth.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2004-346310 filed Nov. 30, 2004 including specification, drawings and claims is incorporated herein by reference in its entirety.

What is claimed is:

1. An industrial two-layer fabric which comprises ten pairs of warps obtained by vertically arranging ten upper surface side warps and ten lower surface side warps, and a plurality of upper surface side wefts and lower surface side wefts, and has an upper surface side layer and a lower surface side layer bound with warp-direction yarns, wherein:

in the lower surface side layer, warps are formed by sequentially arranging a design in which one warp passes over six successive lower surface side wefts, passes under one lower surface side weft, passes over two lower surface side wefts, and passes under one lower surface side weft while shifting the design by three lower surface side wefts; two adjacent lower surface side warps simultaneously weave therein one lower surface side weft from the lower surface side, whereby the lower surface side weft passes over two lower surface side warps and then passes under eight lower surface side warps to form a weft long crimp corresponding to eight lower surface side warps on the lower surface side surface; and by forming a portion in which a lower surface side warp and each of lower surface side warps on both adjacent sides thereto alternately passes under a lower surface side weft, the lower surface side warp is brought into contact with the lower surface side warps on both adjacent sides thereto alternately and is placed in a zigzag arrangement.

2. An industrial two-layer fabric according to claim 1, wherein an upper surface side warp and lower surface side warp of at least one of the ten pairs of an upper surface side warp and a lower surface side warp arranged vertically are both warp binding yarns which are woven with an upper surface side weft and a lower surface side weft to constitute a portion of an upper surface side surface design and a portion of a lower surface side surface design; and warp binding yarns forming a pair are woven with respective upper surface side wefts and cooperatively function as one warp to constitute an upper surface side complete design on an upper surface side surface, while the warp binding yarns forming a pair constitute, similar to a lower surface side warp, a lower surface side surface design on the lower surface side surface.

3. An industrial two-layer fabric according to claim 1, wherein an upper surface side warp of at least one of the ten pairs of an upper surface side warp and a lower surface side warp arranged vertically is a warp binding yarn which is woven with an upper surface side weft and a lower surface side weft to constitute a portion of an upper surface side surface design and a portion of a lower surface side surface design; and in the pair of a warp binding yarn and a lower surface side warp, the warp binding yarn is woven with an upper surface side weft to function as one warp constituting an upper surface side complete design on an upper surface side surface, while on the lower surface side surface, the warp binding yarn and the lower surface side warp cooperatively constitute, similar to another lower surface side warp, a lower surface side surface design.

4. An industrial two-layer fabric according to claim 1, wherein a lower surface side warp of at least one of the ten pairs of an upper surface side warp and a lower surface side warp arranged vertically is a warp binding yarn which is woven with an upper surface side weft and a lower surface side weft to constitute a portion of an upper surface side surface design and a portion of a lower surface side surface design; and in the pair of a warp binding yarn and an upper surface side warp, the warp binding yarn and the upper surface side warp are woven with respective upper surface side wefts and cooperatively function as one warp constituting an upper surface side complete design on an upper surface side surface, while the warp binding yarn constitutes, similar to a lower surface side warp, a lower surface side surface design on the lower surface side surface.

5. An industrial two-layer fabric, wherein one of the warp binding yarns forming a pair as claimed in claim 2 is woven with at least one upper surface side weft to form an upper surface side surface design, under which the other warp binding yarn is woven with one lower surface side weft, while the one warp binding yarn is woven with one lower surface side weft, over which the other warp binding yarn is woven with at least one upper surface side weft to constitute the upper surface side surface design, whereby the warp binding yarns forming a pair complement each other to form the upper surface side surface design and lower surface side surface design.

6. An industrial two-layer fabric according to any one of claims 1 to 5, wherein a warp design constituting the upper surface side surface is any one of 2-shaft plain weave, 4-shaft twill weave, 4-shaft broken twill weave, 5-shaft twill weave, 5-shaft broken twill weave, 10-shaft twill weave and 10-shaft broken twill weave.

7. An industrial two-layer fabric according to any one of claims 1 to 5, wherein one or more than one auxiliary weft is arranged between the upper surface side wefts.

8. An industrial two-layer fabric according to any one of claims 1 to 5, wherein the number of the upper surface side wefts is 1 to 2 times the number of the lower surface side wefts.

9. An industrial two-layer fabric according to any one of claims 1 to 5, wherein the upper surface side warp and the lower surface side warp are equal in diameter.

* * * * *